United States Patent [19]

Martinez

[11] 4,089,146

[45] May 16, 1978

[54] SUSPENDED CEILING

[76] Inventor: Vincent Martinez, 2078 E. Oakwood St., Pasadena, Calif. 91104

[21] Appl. No.: 683,760

[22] Filed: May 6, 1976

[51] Int. Cl.[2] ..... E04B 5/55

[52] U.S. Cl. ..... 52/484; 52/488; 52/496

[58] Field of Search ..... 52/484, 488, 496, 28, 52/30, 493, 495

[56] References Cited

U.S. PATENT DOCUMENTS

| | | | |
|---|---|---|---|
| 3,058,172 | 10/1962 | Phillips | 52/496 |
| 3,175,656 | 3/1965 | Schoenfeld | 52/496 |
| 3,415,030 | 12/1968 | Phillips | 52/493 |
| 3,550,341 | 12/1970 | Thompson | 52/488 |
| 3,708,941 | 1/1973 | Cuckson | 52/484 |
| 3,877,190 | 4/1975 | Corcoran | 52/731 |

*Primary Examiner*—John E. Murtagh

[57] ABSTRACT

A hollow runner for the support of tile ceiling comprising an elongated member having throughout its length the same asymmetric cross-section comprising:

a closed upper end wall, closed generally downwardly extending side walls depending from said closed upper end, lateral oppositely disposed undercuts in each of said side walls for receiving suspending means, a lower end wall depending from said side walls having a slot therein extending the length of said runner adapted to slidably receive an upright and retain the same with a press or interference fit, a lateral flange depending from only one of said side walls, said flange being adapted to support the edge of ceiling tile.

7 Claims, 75 Drawing Figures

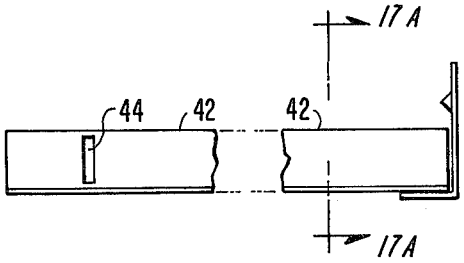
FIG.-17
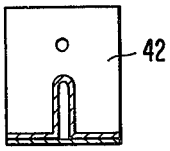
FIG.-17A
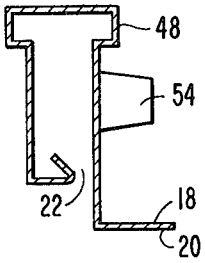
FIG.-18A
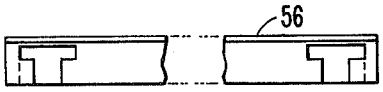
FIG.-19
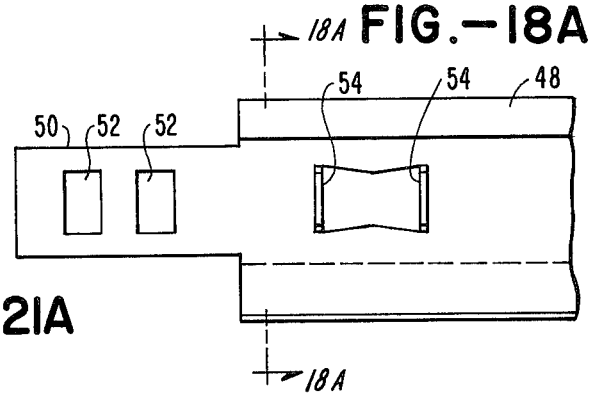
FIG.-18
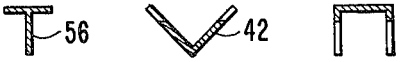
FIG.-19A FIG.-20A FIG.-21A
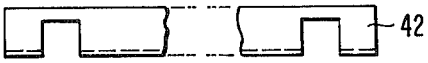
FIG.-20
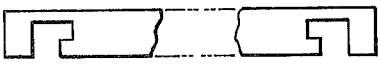
FIG.-21
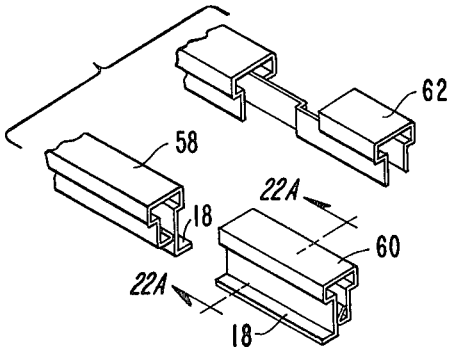
FIG.-22
FIG.-22A
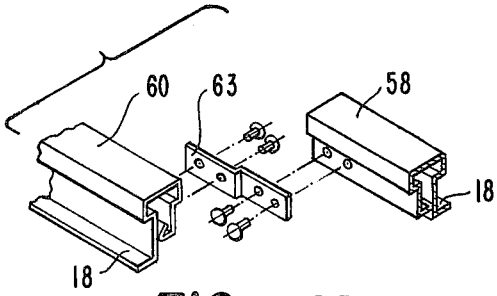
FIG.-23
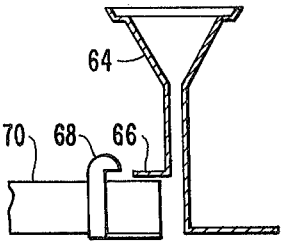
FIG.-24
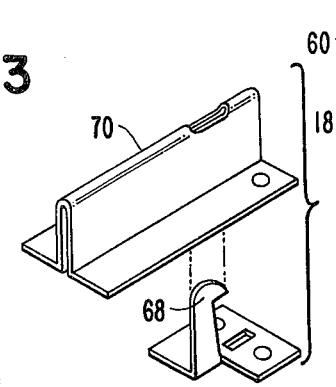
FIG.-24A
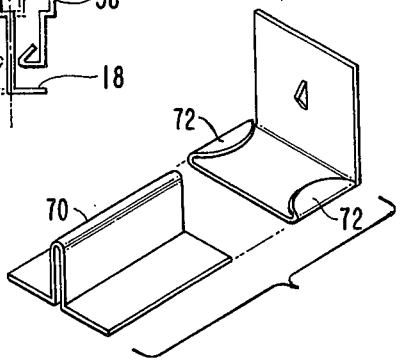
FIG.-25

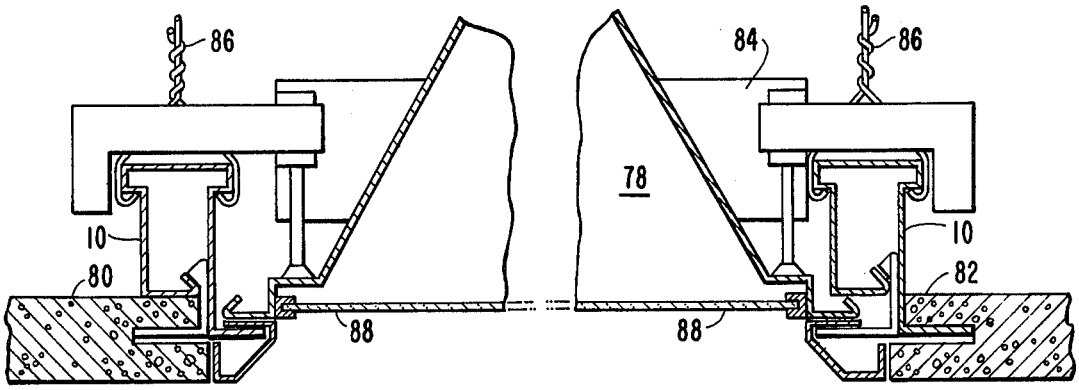
FIG.-30
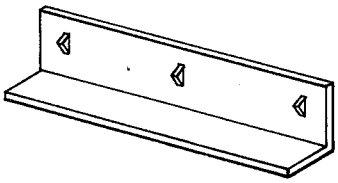
FIG.-30A
FIG.-31
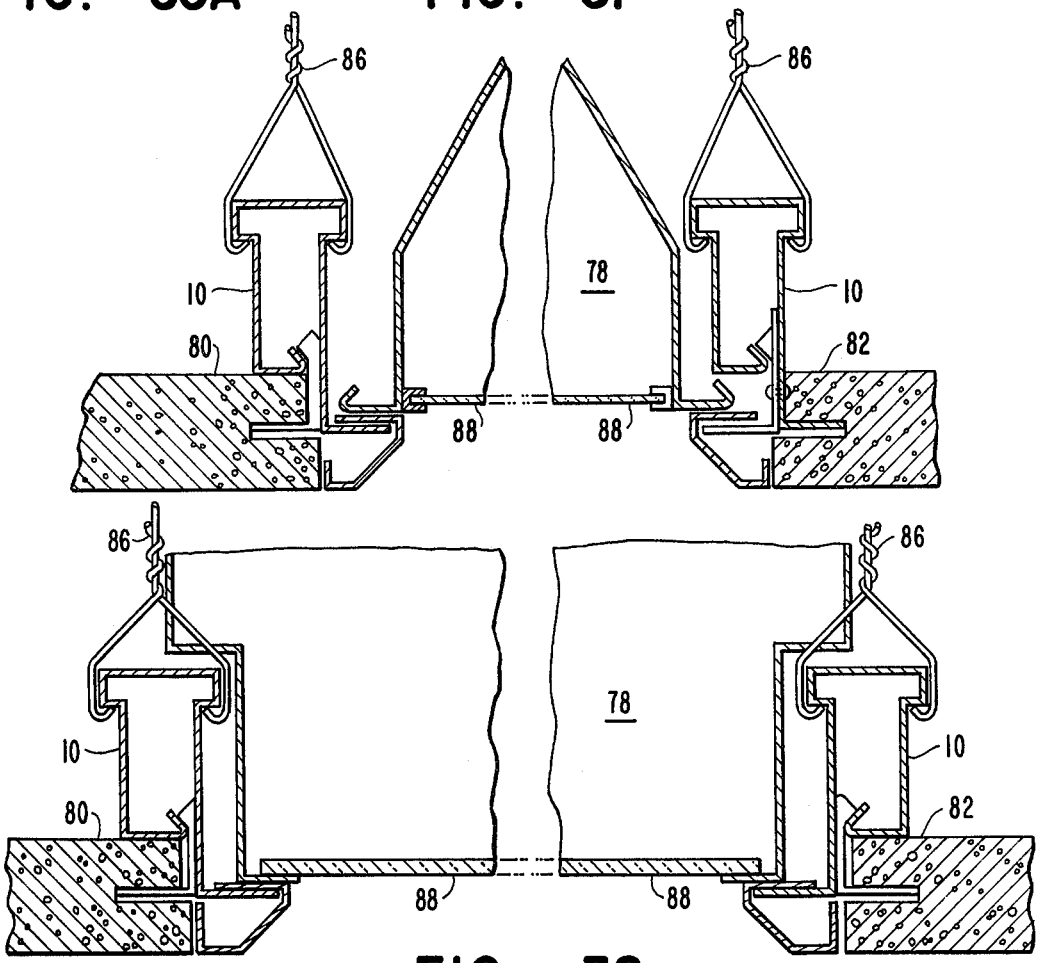
FIG.-32

FIG.-41
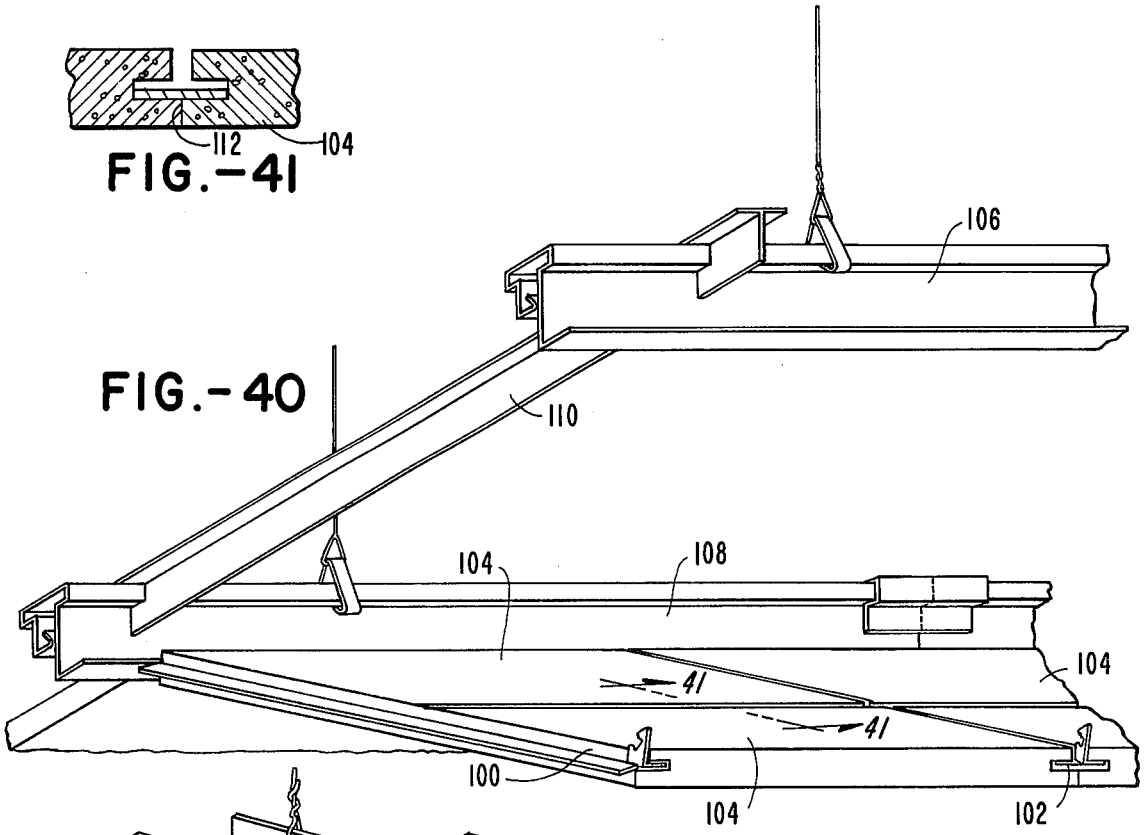
FIG.-40
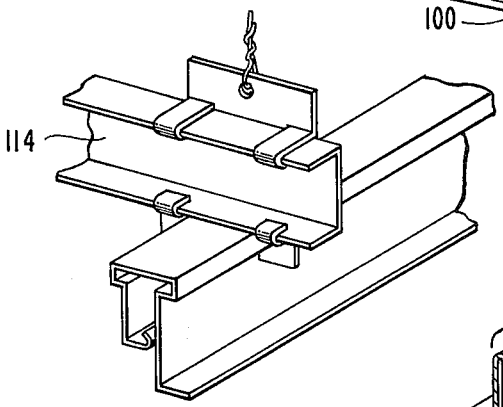
FIG.-42
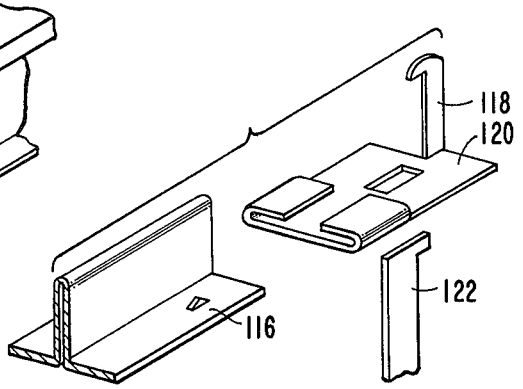
FIG.-43
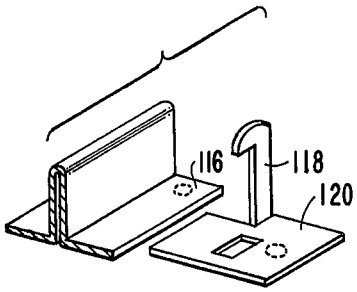
FIG.-44
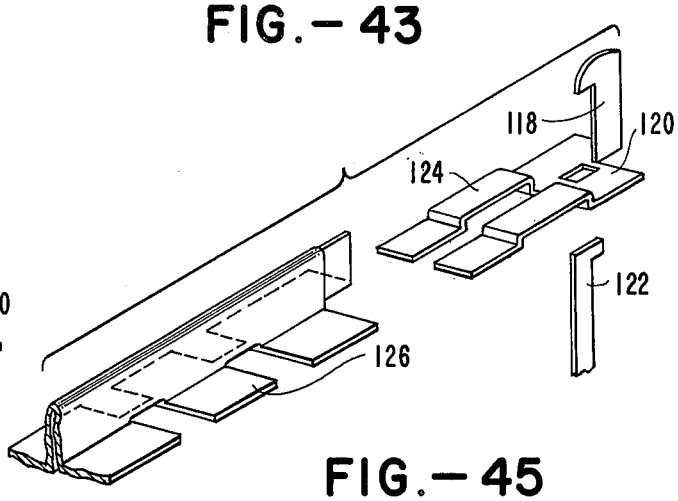
FIG.-45

SUSPENDED CEILING

BACKGROUND OF THE INVENTION

Generally, construction of ceilings in office buildings and other commercial buildings consists of metal T-bars inverted and set at certain rectangular patterns, fastened together and suspended horizonally from the building structure by the use of metal hanger wires. Thus, is created a grid of metal "windows" or frames with horizontal ledges. Rectangles or squares of sound absorbing material about 1 inch thick are laid in the "windows" on the horizontal ledges creating an acoustical ceiling. The space above the acoustical ceiling is used to create a cavity or plenum space wherein certain building services are housed such as air conditioning ducts, plumbing pipes, and electrical wiring conduits and wires, as well as providing space for recessed lighting fixtures. Access to the plenum above this type of ceiling is by the tilting and removal of the acoustical tiles or panels.

Further refinements of the above ceiling have been designed and manufactured which conceal the horizontal surfaces of the grid or T-bar system. This is called a concealed ceiling system. Concealment of the T-bar system is accomplished by ship lapping the acoustical tiles where they rest on the T-bars and holding the adjacent tiles in the same plane by the use of rectangular splines inserted into slots in the edges of adjacent tiles. This system, however esthetically pleasing, makes it difficult to obtain access to the ceiling cavity above for maintenance purposes. Access doors are sometimes placed in the ceiling where entrance to the ceiling cavity is required. These doors are usually obvious and unsightly.

The ceiling system of this invention provides virtually complete access to the plenum above while maintaining the asthetic integrity of the ceiling. Access is simple, tiles are easily removed, remain undamaged through removal, and are easily returned to their proper position in the ceiling. Moreover less labor is required to install my ceiling than is required to install a conventional concealed ceiling system.

SUMMARY OF THE INVENTION

Briefly, this invention comprises a hollow runner for the support of tile ceiling comprising an elongated member having throughout its length the same asymmetric cross-section comprising:

a closed upper end wall, closed generally downwardly extending side walls depending from said closed upper end, lateral oppositely disposed undercuts in each of said side walls for receiving suspending means, a lower end wall depending from said side walls having a slot therein extending the length of said runner adapted to slidably receive an upright and retain the same with a press or interference fit, a lateral flange depending from only one of said side walls, said flange being adapted to support the edge of ceiling tile.

This invention also includes a ceiling system comprising a plurality of parallel, spaced-apart runners and a plurality of parallel, spaced-apart cross members extending between said runners, each of said runners having throughout its length the same asymmetric cross-section comprising:

a closed upper end wall, closed generally downwardly extending side walls depending from said closed upper end, a lower end wall depending from said side walls having a slot therein extending the length of said runner adapted to receive an upright, a lateral flange depending from only one of said side walls, said flange being adapted to support the edge of ceiling tile, said cross members also being adapted to support the edge of ceiling tile, each cross member resting at one of its ends on said flange and the other of its ends including said upright.

It is an object of this invention to provide a novel runner for the support of suspended ceilings.

It is another object of this invention to provide a novel grid system for suspended ceilings.

These and other objects and advantages of the invention will be apparent from the detailed description which follows.

DESCRIPTION OF THE PREFERRED EMBODIMENTS

Turning to the drawings:

FIG. 1 is a section view of one embodiment of the runner 10 of this invention. The top wall is indicated at 12, the side walls at 14 and 16, the lateral flange 18, the bottom wall 20 and the slot 22, the undercuts are 24 and 26.

Figure 13:
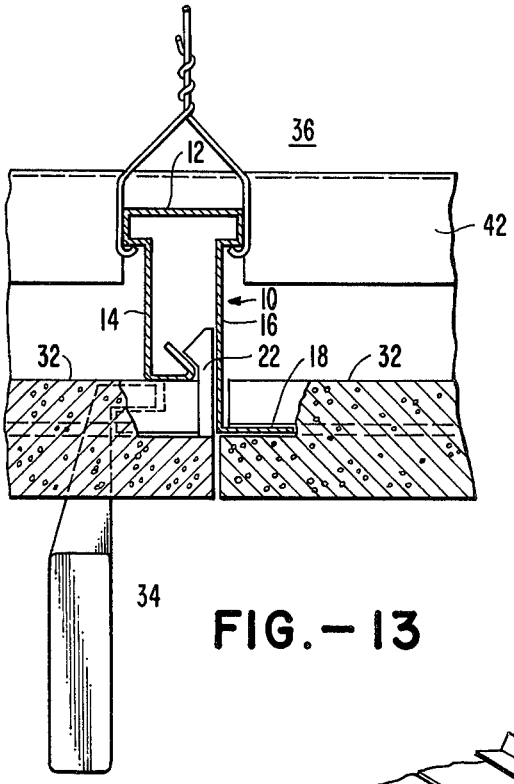

FIG. 13 is an enlarged sectional view of the runners of FIGS. 1 to 5 and the cross-tee of FIGS. 6 to 9, with ceiling tiles 32 in place and showing the use of a tool 34 to "pull down" a tile for access to the plenum 36.

Figure 14:
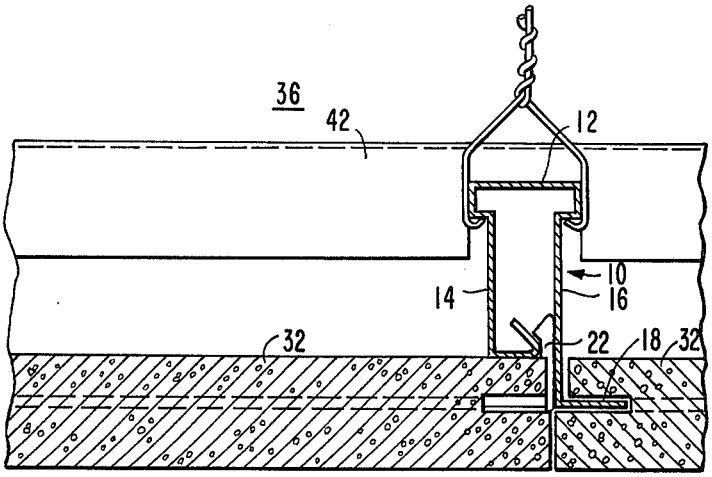

FIG. 14 shows the same general view as FIG. 13, but without the tool 34.

Figure 14A:
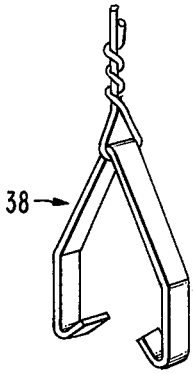

FIG. 14A is a perspective view of a typical hanger 38 used to suspend the runners of this invention from the plenum or the underside of the ceiling at the upper extremity of the plenum.

Figure 15:
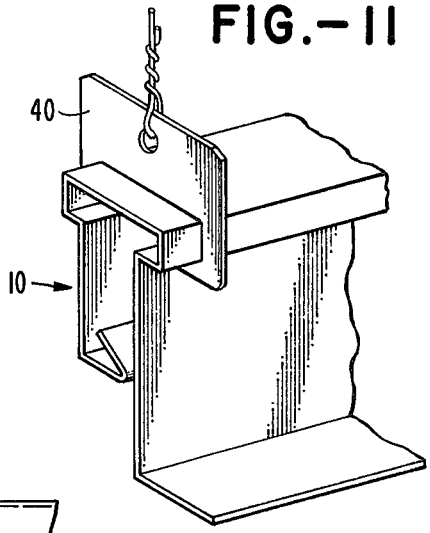

FIG. 15 is a perspective view of another embodiment of a hanger 40 which can be used in lieu of the hanger of FIG. 14A.

Figure 16:
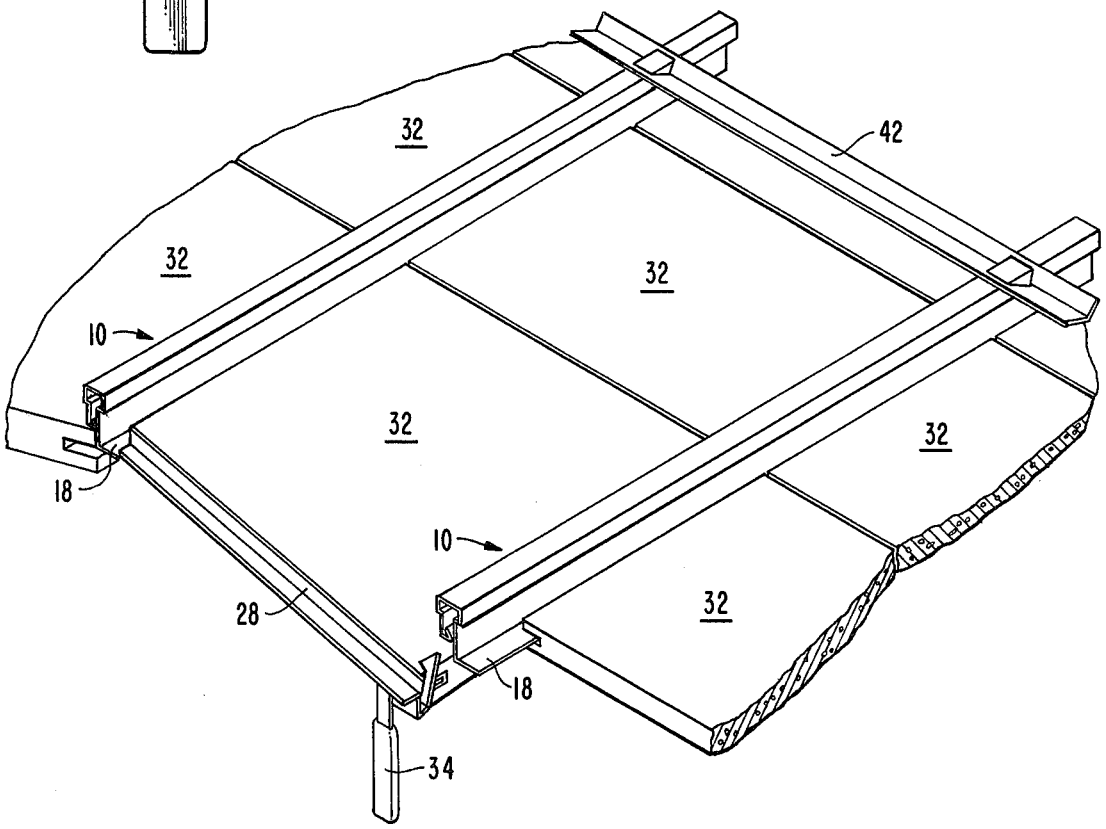

FIG. 16 is a top perspective view showing two runners and a cross-tee as ceiling tile is being lowered using a tool. This view also showing an inverted Vee-strut 42.

Figure 10:
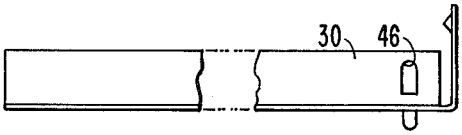
FIG. 10 is a side view of another embodiment of cross-member 30 in this instance, a cross "half" tee.
Figure 11:
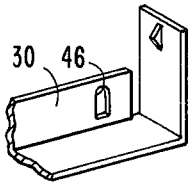
FIG. 11 is a perspective view of the right hand end of the cross-member of FIG. 10.

FIG. 17 shows an embodiment of a cross-tee 42 wherein the opening 44 is remote from the vertical upright. The opening 44 receives the tool 34 and when downward force is applied without any resulting downward movement, this indicates that the tool should be used at the other end of the cross-tee, either within the tee or in an opening 46, such as is shown in FIGS. 10 and 11.

FIG. 17A is a section view along the line 17A—17A in FIG. 17.

FIG. 18 is a side view of another embodiment of runner 48.

FIG. 18A is a section along the line 18A—18A in FIG. 18.

Figure 1:
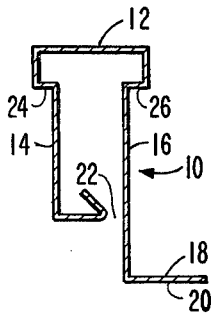
Figure 5:
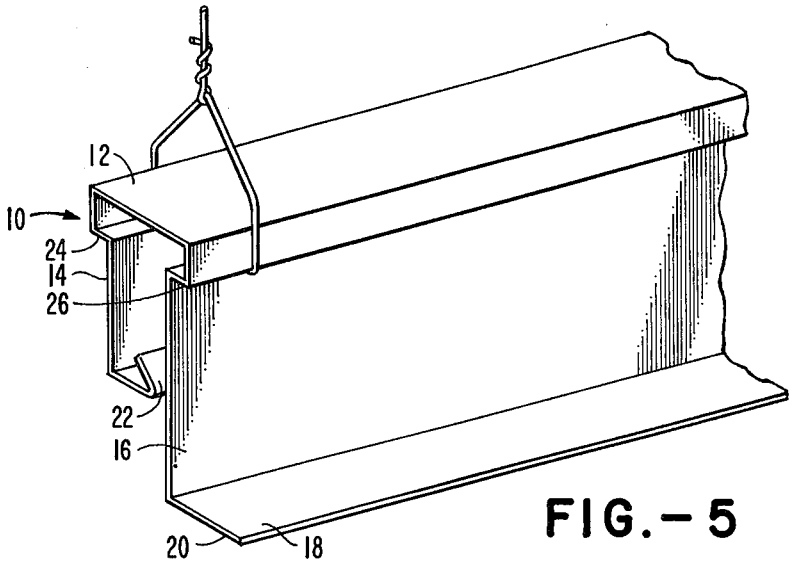
FIG. 5 is a perspective view showing the flange-side of the runner of FIG. 1.
Figure 2:
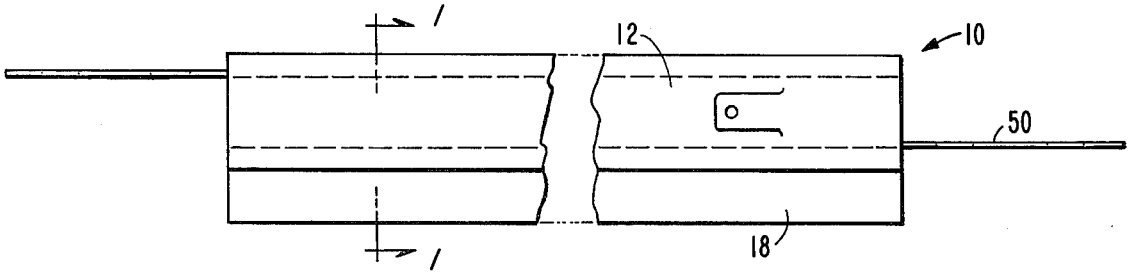
FIG. 2 is a top view of the runner of FIG. 1.
Figure 3:
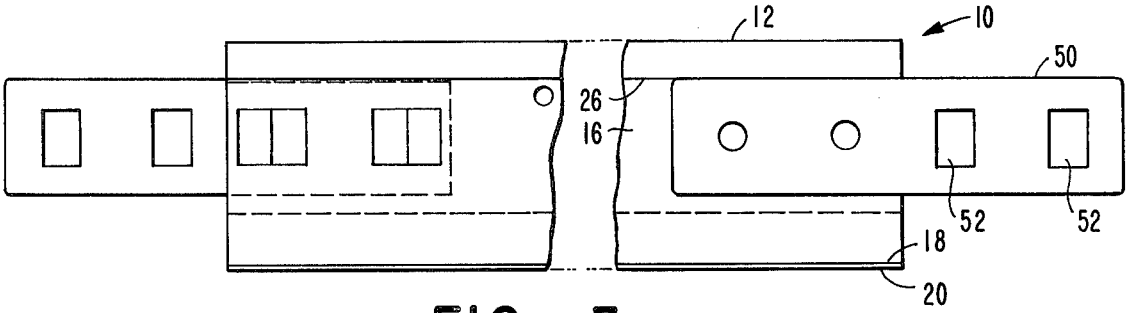
FIG. 3 is a view of one side of the runner of FIG. 1.
Figure 4:
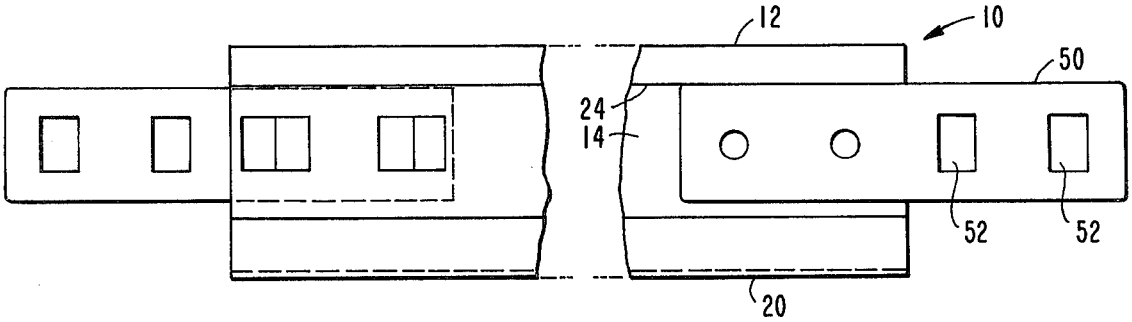
FIG. 4 is a view of the other side of the runner of FIG. 1.
Figure 7:
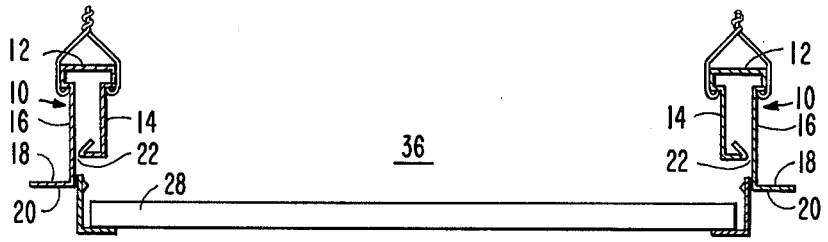
FIG. 7 is a side view with the cross-tee of FIG. 6 in place between two of said runners, the runners being shown in cross-section.
Figure 6:
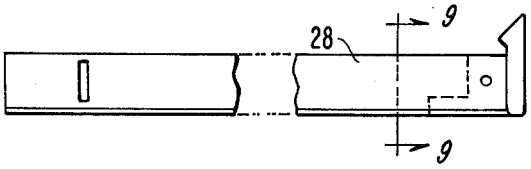
FIG. 6 is a side view of one type of cross-tee 28 used between two of the runners, for example, of FIG. 1.
Figure 8:
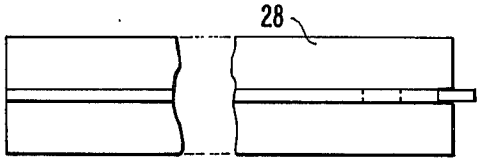
FIG. 8 is the top view of the cross-tee shown in FIGS. 6 and 7.
Figure 9:
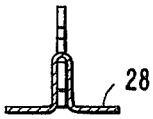
FIG. 9 is a section view taken along the line 9—9 in FIG. 6.

As in FIGS. 2 to 4, the runner can terminate in an extension 50 having openings 52 therein which are engageable with metal projections 54 on the end of the adjacent runner to connect or join the pieces of runner in an end-to-end relationship.

FIG. 19 is a side view of a strut 56 used to maintain spacing between adjacent runners.

FIG. 19A is a sectional view of the strut of FIG. 19.

FIG. 20 is a side view of the V-strut, previously discussed in reference to FIG. 16.

FIG. 20A is a sectional view of the strut of FIG. 20.

FIG. 21 is a side view of a U-shaped strut which can be used in lieu of either the strut of FIGS. 19 and 19A, or the strut of FIGS. 20 and 20A.

FIG. 21A is a sectional view of the strut of FIG. 21.

FIG. 22 shows two lengths of runner 58 and 60, and another type of connector 62 for maintaining the lengths of runner in an end-to-end relationship. As is apparent, connector 62 in use is seated atop the two lengths of runner and holds them in end abutment. Note that this arrangement permits the jointure of two runners with the flange on one runner reversed with respect to the flange on the adjacent runner. This reversal of flange position provides greater flexibility to accommodate lighting fixtures and other interrupting items in a ceiling without the necessity for a plurality of different kinds of runners.

FIG. 22A is a section along the line 22A—22A in FIG. 22.

FIG. 23 shows the use of pop riveted element 63 which performs essentially the same function as connector 62 in FIG. 22 and 22A.

FIG. 24 is a section showing another embodiment of runner 64 wherein the end wall 66 is reversed and the upright 68 on cross-tee 70 is slidably received on the end wall 66. In this arrangement, the ceiling tile can be dropped down simply by sliding the enlarged end of upright 68 off of wall 66 and pulling down.

FIG. 24A illustrates, in perspective, one assembly of the cross-tee of FIG. 24.

FIG. 25 shows in perspective another way of joining the upright to the cross-tee itself, viz, by sliding the flanges of the cross tee under tabs 72 and crimping the tabs.

Figure 26:
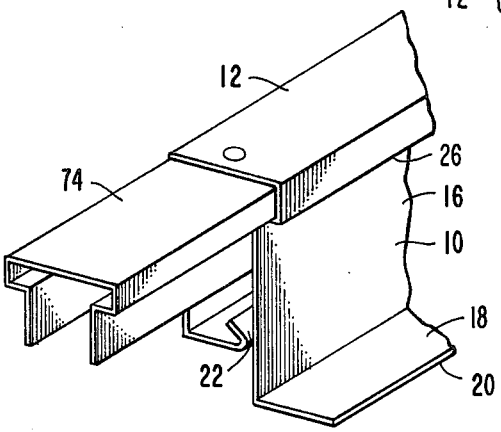

FIG. 26 is a perspective view of the runner wherein end-to-end abutment with an adjacent runner (not shown) is maintained by snugfitting internal connector 74.

Figure 27:
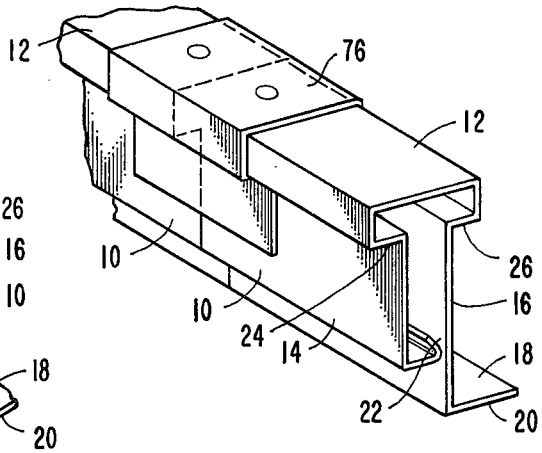

FIG. 27 is like FIG. 26 except that the connector 76 is larger than and external to the two runner being held in abutting relationship.

Figure 28:
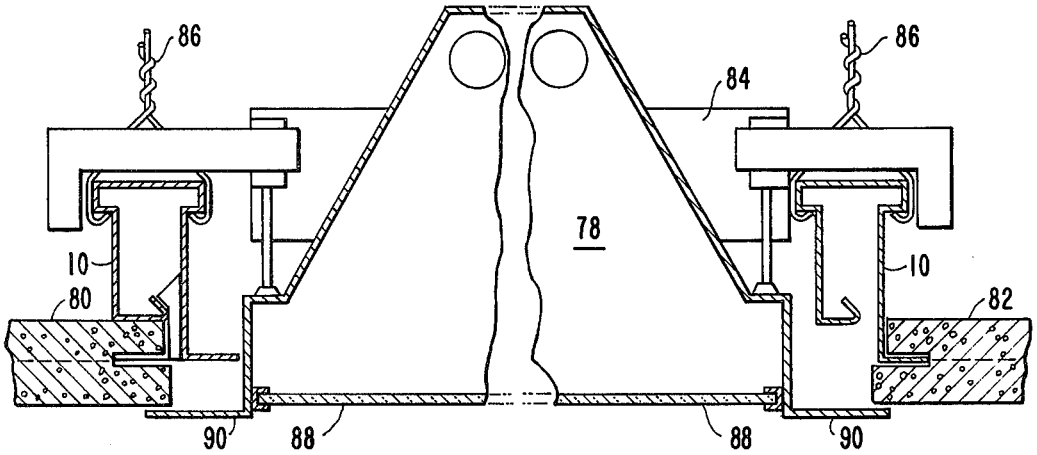

FIG. 28 is a sectional view showing a light fixture 78 positioned between two runners. The ties are indicated at 80 and 82, 82, the strut at 84, and hangers at 86. The element 88 is a light diffuser.

Figure 29:
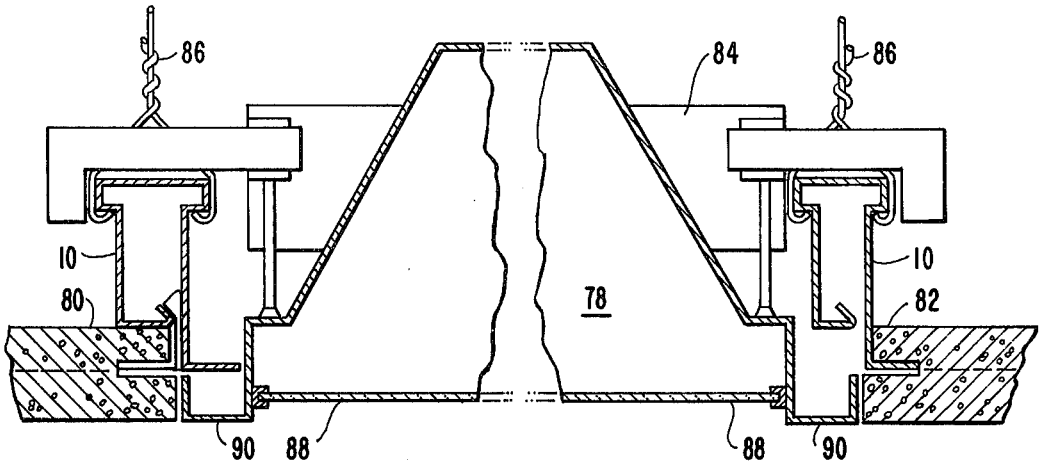
Figure 33:
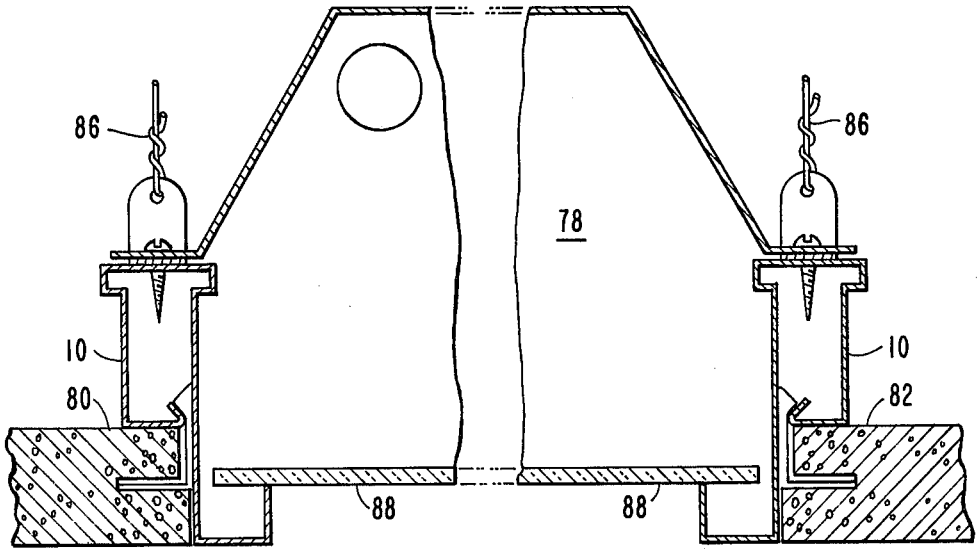
Figure 34:
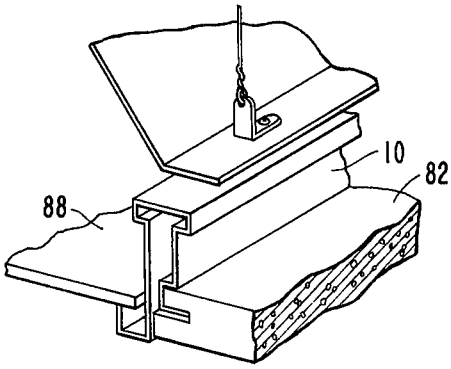
Figure 35:
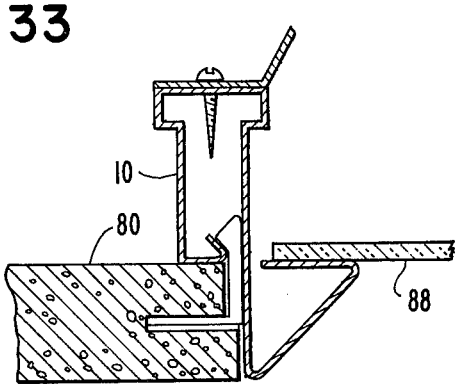

FIG. 29 is similar to FIG. 28, but the exposed metal area 90 is different than the metal 92 in FIG. 29, which provides a different visual effect when viewed from below.

FIGS. 30 through 33 illustrate other combinations of a light fixture and runners according to this invention.

FIGS. 34, 35, 38, 39, 46 through 48 and 51 through 66 illustrate other runner configurations within the scope of this invention.

Figure 36:
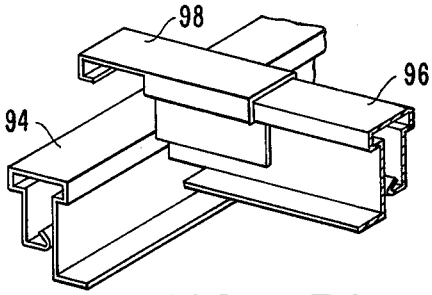
Figure 37:
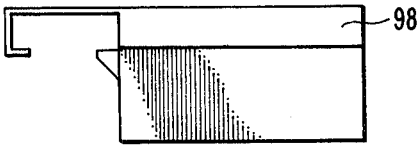
Figure 38:
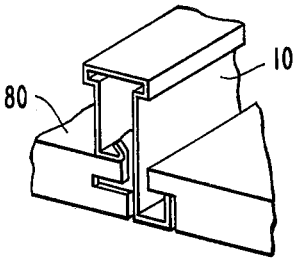
Figure 39:
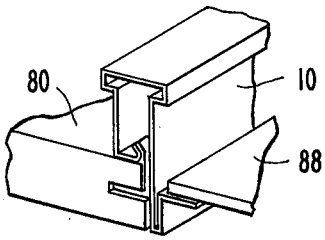
Figure 51:
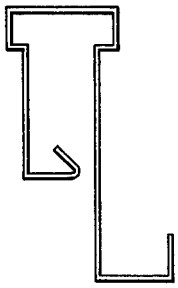
Figure 52:
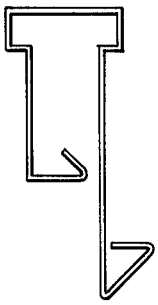
Figure 53:
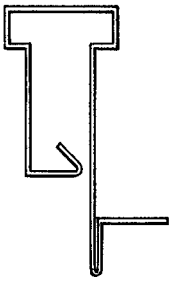
Figure 54:
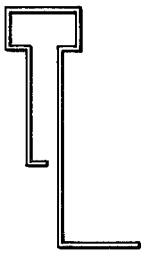
Figure 55:
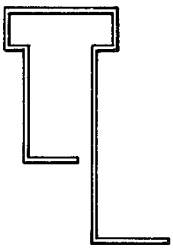
Figure 56:
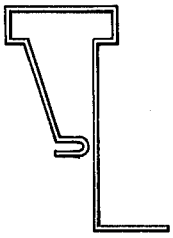
Figure 57:
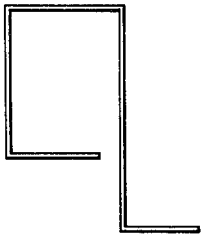
Figure 58:
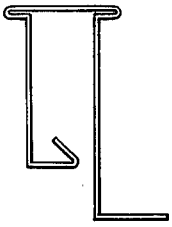
Figure 59:
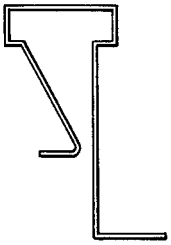
Figure 60:
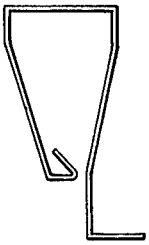
Figure 61:
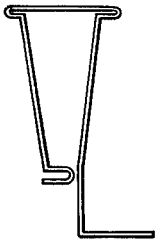
Figure 62:
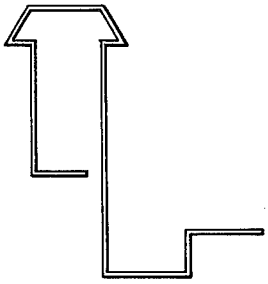
Figure 63:
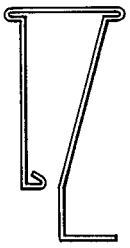
Figure 64:
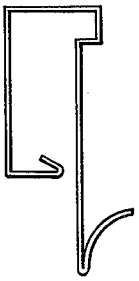
Figure 65:
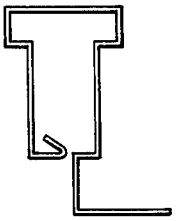
Figure 66:
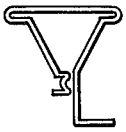
Figure 46:
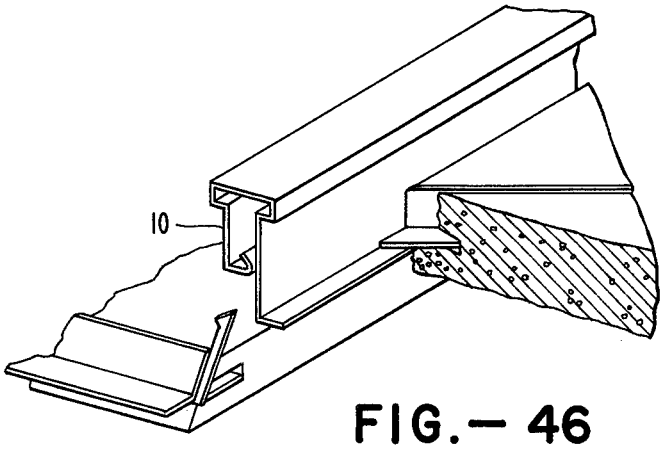
Figure 47:
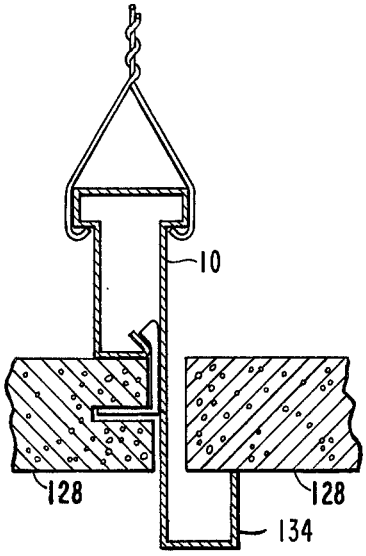

FIGS. 36 and 37 illustrate the right angle joinder of runners 94 and 96 with the benefit of external connector 98.

FIG. 40 shows several cross-tees 100 and 102 carrying tiles which are rotated down from the runner 106, rotating being about runner 108. Note tee shaped strut 110 to maintain separation.

FIG. 41 is a section along line 41—41 in FIG. 40. The spline 112 maintains edge-to-edge relationship of adjacent tiles, permitting wider spacing of runners.

FIG. 42 shows the use of a channel 114 in lieu of the tee, vee, or U strut previously discussed.

FIG. 43 shows a cross-tee 116, upright 118 which has a base 120 which slidably receives the cross-tee so that tool 122 can be used to slide the upright 118 back and forth relative to the tee 116, hence providing another method of opening the ceiling.

FIG. 44 simply shows in side-by-side exploded view that the upright can be welded to the cross tee.

FIG. 45 shows another arrangement wherein the upright is slidable with respect to the cross tee, and is generally analogous to the structure of FIG. 43. However, it should be noticed that raised portion 124 and flange portion 126 engage to limit the sliding of the upright back and forth with respect to the crosstee.

Figure 50:
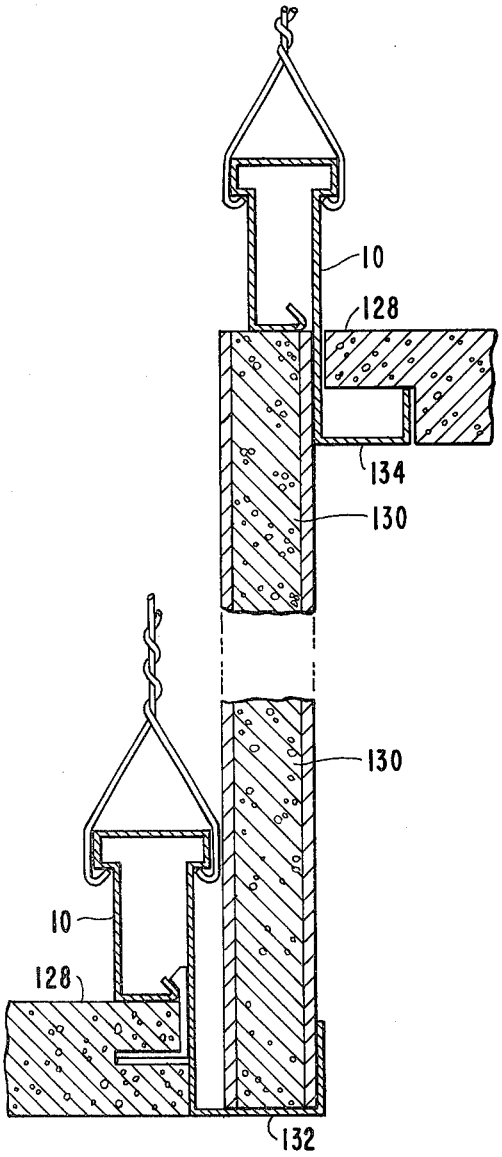
Figure 49:
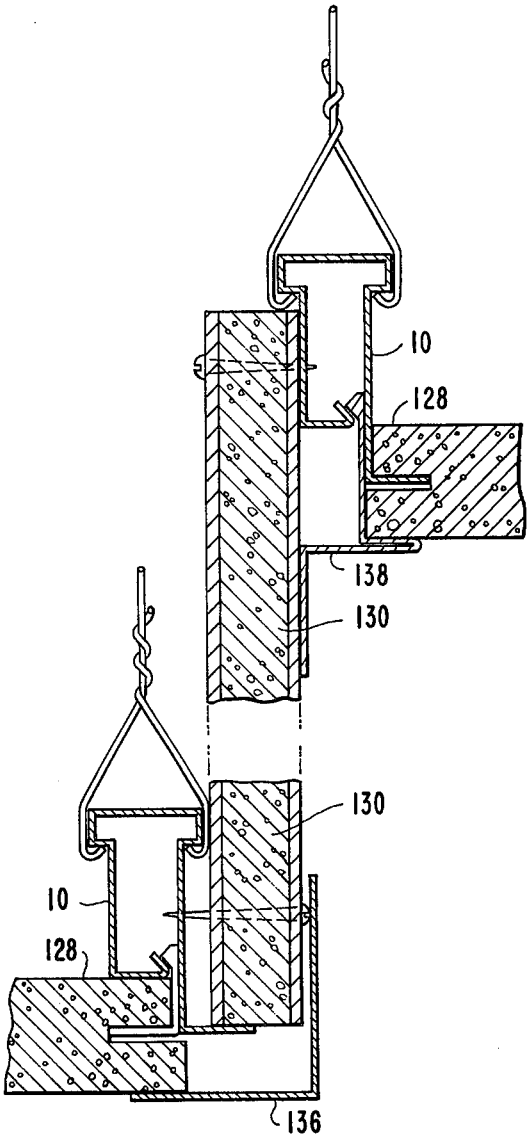

FIGS. 49 and 50 show horizontal and vertical tiles 128 and 130. As can be seen, the runners of this invention are versatile and permit the incorporation of tiled recesses within the ceiling and at the same time provide pleasing edge effects of exposed metal, as shown at 132, 134, 136 and 138.

In the following explanation a distinction will be made between the left and the right side of the main runner. The main runner can be connected to another main runner in the usual form (example right side with right side and left side with left side) using connections as per FIGS. 2, 3, or 4. An exterior coupling connector and interior coupling connector can also be used, see FIGS. 26 and 27. At any given point the left side of the runner can connect to right side and right side with left side, see FIGS. 22, 23, and 23A.

It should be apparent from the drawings and foregoing description that the flange on the asymmetric runner of this invention provides both support for the edge of the tile and acts as the approximate axis of rotation when the tile is to be lowered. The tiles are also supported on each of their sides by cross-tees or their equivalent. Thus, each tile is always supported on three of its edges.

This system consists of main runners positioned parallel to each other directly suspended with hanger wire. Lateral spacing of the system is accurately maintained by struts. See FIGS. 19, 20, and 21. At the same time the main runner supports the cross tee. See FIGS. 6, 8, and 9. These cross tees are perpendicular to the main runners. At the same time the cross tees support the flat splines. See FIG. 41. These flat splines are parallel to the main runner.

Figure 12:
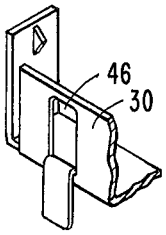
FIG. 12 is a perspective view of the opposite side of the end shown in FIG. 11.

One end of the cross tee rests on the main runner and the opposite end is snapped into the main runner. See FIGS. 13, 14, 17, and 25. For half cross tee see FIGS. 10, 11, and 12.

The main runner and cross tee are inserted in the three edges of acoustical tile.

To remove one or more tiles without disturbing main runner, a special key is used to disengage cross tee (see FIG. 13).

Three different kinds of clips can be used for suspending the main runner. See FIGS. 5, 15, and 14A, and FIG. 2 for special punch tab in the main runner which may be used for suspension.

This system offers a variety of combinations and may be applied to any design.

Position of the main runners can be altered (see FIGS. 32 and 33) allowing installation of any recessed light fixtures. See FIGS. 28, 29, 30, 31, 32, 33, 34 and 35. This versatility makes this system easy, economical and practical.

Another possibility is to construct a light fixture by installing a special cover plate over the main runner. See FIGS. 33 and 35 and even the main runner. In these Figures, the left side of the main runner is concealed and the right side is exposed. This variation allows flexibility of design making it possible to have different combinations of acoustical tile and exposed main runner.

This system allows the making of the perimeter on a luminous ceiling. Exposed and concealed main runners can be connected to each other. This special connection allows the possibility of obtaining special trims. See FIG. 47.

Figure 48:
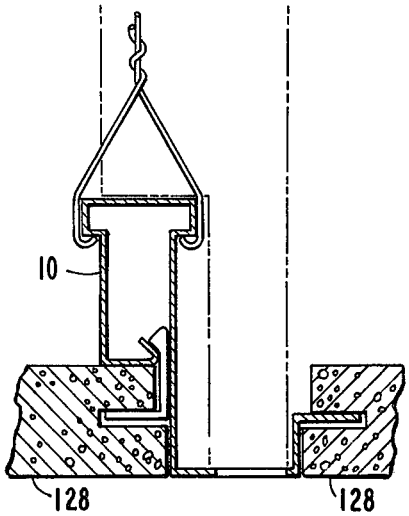

In FIG. 48, there is shown a specially perforated main runner prepared to receive an air conditioning boot. This is the simplest and most practical way to create a linear air bar. This system is also easy to combine with other concealed or exposed systems, as well as the construction of soffits and drapery pockets. See FIGS. 49 and 50.

In certain office or other commercial ceilings, the perimeters of the ceilings, usually at the windows are designed to have drapery pockets to conceal the hardware associated with draperies. This pocket is created by regressing a portion of the ceiling 4 inches or more above the plane of the general ceiling. These drapery pockets are most easily created by the use of formed sheet metal troughs which are expensive and time consuming to install. The use of certain embodiments of the invention, particularly as shown in FIGS. 49 and 50 can be used to create drapery pockets quickly and economically.

At any point the main runner positions can be rotated. See FIGS. 36 and 37 for special slip.

This system allows the connection of channels for special ceilings by using the clip (see FIG. 42) also connection to main structure of building.

In comparison to the only other system with 100% accessibility, this system allows the advantage of simplicity, flexibility, adaptability to any type of recessed light fixture, luminous ceiling, or concealed ceiling; thus, a broader range of combinations are possible.

Instead of using one end of the cross tee snapped into the main runner, a sliding cross tee can be used, see FIGS. 24, 43, 44, and 45. This system allows easy and simple access. See FIGS. 30 and 31 for special angle.

Having fully described the invention it is intended that it be limited only by the lawful scope of the appended claims.

I claim:

1. A ceiling system comprising a plurality of parallel, spaced-apart runners and a plurality of parallel, spaced-apart cross members extending between said runners, each of said runners consisting of an elongated member having throughout its length the same asymmetric cross-section comprising:

a closed upper end wall, closed generally downwardly extending side walls depending from said closed upper end, a lower end wall depending from said side walls having a slot therein extending the length of said runner adapted to receive an upright, a lateral flange depending from only one of said side walls, said flange being adapted to support the edge of ceiling tile, said cross members also being adapted to support the edge of ceiling tile, each cross member resting at one of its ends on said flange and the other of its ends including said upright.

2. The ceiling system of claim 1 wherein each tile is supported at three of its edges, one of which is at a runner about which said tile is rotatable.

3. The ceiling system of claim 1 wherein the uprights are slidably received in the runners with a press or interference fit.

4. The ceiling system of claim 1 wherein the runners have lateral oppositely disposed undercuts in each of said side walls which receive suspending means.

5. The ceiling system of claim 1 wherein the side walls of said runners are generally parallel to each other and perpendicular to said upper end wall.

6. The ceiling system of claim 1 wherein the lateral flange of said runners is perpendicular to the side wall.

7. The ceiling system of claim 4 wherein the undercuts are disposed on the side wall in a plane which lies between the end wall and the lateral flange.

* * * * *